US008020499B2

(12) United States Patent
Chu et al.

(10) Patent No.: US 8,020,499 B2
(45) Date of Patent: Sep. 20, 2011

(54) APPARATUS AND METHOD FOR PYROLYSIS OF SCRAP TYRES AND THE LIKE

(75) Inventors: Wai Tak Chu, Wanchi (HK); Chi Wai Hui, Clear Water Bay (HK); Bai Ru He, Dongguan (CN); Zhi Qiang Wu, Dongguan (CN); King Lung Lee, Wanchai (HK); Chin Man Lee, Wanchai (HK)

(73) Assignee: Overseas Capital Assets Limited, Tortola (VG)

( * ) Notice: Subject to any disclaimer, the term of this patent is extended or adjusted under 35 U.S.C. 154(b) by 402 days.

(21) Appl. No.: 11/937,996

(22) Filed: Nov. 9, 2007

(65) Prior Publication Data

US 2009/0120335 A1 May 14, 2009

(51) Int. Cl.
*F23G 5/12* (2006.01)

(52) U.S. Cl. ..... 110/229; 110/342

(58) Field of Classification Search ..... 110/229, 110/230, 342; 202/113
See application file for complete search history.

(56) References Cited

U.S. PATENT DOCUMENTS 3,371,429 A * 3/1968 Miller et al. ..... 34/171
4,122,036 A 10/1978 Lewis
4,201,141 A * 5/1980 Teodorescu et al. ..... 110/259
4,203,804 A 5/1980 Janning et al.
4,308,103 A 12/1981 Rotter
4,539,917 A * 9/1985 Mallon et al. ..... 110/256
4,588,477 A 5/1986 Habib
4,647,443 A 3/1987 Apffel
4,648,328 A 3/1987 Keough
4,686,008 A 8/1987 Gibson
4,732,092 A * 3/1988 Gould ..... 110/229
4,983,278 A 1/1991 Cha et al.
4,986,199 A * 1/1991 Komeno et al. ..... 110/347
5,195,449 A * 3/1993 Michimae ..... 110/257
5,225,044 A 7/1993 Breu
5,411,714 A * 5/1995 Wu et al. ..... 110/229
5,427,022 A 6/1995 Gardner
5,720,232 A 2/1998 Meador
5,856,599 A 1/1999 Kuroki
(Continued)

FOREIGN PATENT DOCUMENTS

CN 1030249 A 1/1989
(Continued)

OTHER PUBLICATIONS

Kinetics of scrap tyre pyrolisys under fast heating conditions; Journal of Analytical and Applied Pyrolysis; Roberto Aguado.

(Continued)

*Primary Examiner* — Kenneth Rinehart
*Assistant Examiner* — David J Laux
(74) *Attorney, Agent, or Firm* — William J. Sapone; Coleman Sudol Sapone P.C.

(57) ABSTRACT

A reactor (107) for pyrolysis of carbonizable plastic and rubber materials is disclosed including at least an earlier stage reaction chamber (401) and a later stage reaction chamber (105), in which the earlier stage reaction chamber receives the materials for pyrolysis, and the later stage reaction chamber receives treated materials from the earlier stage reaction chamber for subsequent pyrolysis, and the reactor (107) includes a three-way valve (407) for directing the gaseous pyrolysis products from the later stage reaction chamber to one of three pathways, each to a different destination.

8 Claims, 4 Drawing Sheets

U.S. PATENT DOCUMENTS

| | | | | |
|---|---|---|---|---|
| 5,894,012 | A * | 4/1999 | Denison | 422/150 |
| 6,116,168 | A * | 9/2000 | Brookes | 110/212 |
| 6,133,491 | A | 10/2000 | Xing | |
| 6,271,427 | B1 | 8/2001 | Ershag | |
| 6,832,564 | B2 * | 12/2004 | Hutmacher et al. | 110/341 |
| 6,892,655 | B2 * | 5/2005 | Nunemacher | 110/267 |
| 7,044,069 | B2 * | 5/2006 | Cole et al. | 110/341 |
| 7,108,767 | B2 | 9/2006 | Noto | |
| 2002/0070104 | A1 | 6/2002 | Nichols | |
| 2002/0119089 | A1 | 8/2002 | Masemore et al. | |
| 2002/0159931 | A1 | 10/2002 | Chen | |
| 2004/0204620 | A1 | 10/2004 | Grispin | |
| 2006/0076224 | A1 | 4/2006 | Ku | |
| 2006/0144304 | A1 | 7/2006 | Prigmore | |

FOREIGN PATENT DOCUMENTS

| | | | |
|---|---|---|---|
| CN | 1014417 | B | 10/1991 |
| CN | 2389895 | Y | 8/2000 |
| CN | 2600446 | Y | 1/2004 |
| CN | 2739182 | Y | 11/2005 |
| EP | 0 040 857 | A2 | 12/1981 |
| EP | 1 207 190 | A2 | 5/2002 |
| EP | 1 707 614 | A1 | 10/2006 |
| JP | 56-65090 | | 6/1981 |
| JP | 2002-143821 | A | 5/2002 |
| WO | WO 00/06667 | | 2/2000 |
| WO | WO 02/31082 | A1 | 4/2002 |
| WO | WO 02/37026 | A1 | 5/2002 |
| WO | WO 2005/102639 | A1 | 11/2005 |

OTHER PUBLICATIONS

Optimization of pyrolisys conditions of scrap tires under inert gas atmoshere; Journal of Analytical and Applied Pyrolysis; Mahmood Barbooti.

Mass Spectrometry validation of a dinetic model for the thermal decomposition of tyre wastes; Journal of Analytical and Applied Pyrolysis; J.A. Conesa.

Characterization of the liquid products obtained in tyre prolysis; Journal of Analytical and Applied Pyrolysis; M.F. Laresgoiti.

* cited by examiner

APPARATUS AND METHOD FOR PYROLYSIS OF SCRAP TYRES AND THE LIKE

FIELD OF THE INVENTION

This invention relates to an apparatus and method for the pyrolysis treatment of solid carbonizable plastic, rubber material and the like, in which the main constituents of the materials are of different pyrolysis temperatures. Taking waste tyres as an example, the natural rubber of the waste tyres pyrolyzes and/or cyclized at around 623K, the cyclized constituents, polybutadiene rubber (PBR) and styrene butadiene (SBR) of waste tyres pyrolyzes/cyclized at around 723K, and nearly all the organic volatiles gasify at a temperature below 873K. Carbon black and steel wires of waste tyres will not undergo pyrolysis and remain as solid residue after the pyrolysis process.

DESCRIPTION OF PRIOR ART

A number of apparatus are known for production of pyrolysis oils and other products by the pyrolysis of waste plastics, waste tyres and the like. U.S. Patent Application Publication No. US 2002/0159931 A1 and European Patent Publication No. EP 1,207,190 A2 provide information on how the process parameters can affect the products of pyrolysis. Besides, academic researches, including "*Kinetics of scrap tyre pyrolysis under fast heating conditions*", R. Aguado et al./J. Anal. Appl. Pyrolysis 73 (2005) 290-298, "*Optimization of pyrolysis conditions of scrap tires under inert gas atmosphere*", M. M. Barbooti et al./J. Anal. Appl. Pyrolysis 72 (2004) 165-170, "*Mass spectrometry validation of a kinetic model for the thermal decomposition of tyre wastes*", J. A. Conesa et al./J. Anal. Appl. Pyrolysis 43 (1997) 83-96, and "*Characterization of the liquid products obtained in tyre pyrolysis*", M. F. Laresgoiti et al./J. Anal. Appl. Pyrolysis 71 (2004) 917-934 also discuss the effects of pyrolysis feed properties, heating rate and pyrolysis temperature on the pyrolysis products and kinetics.

U.S. Pat. No. 4,030,984 discloses a method and apparatus by which the whole tyres are suspended in hot gases, and then carbonaceous material of the waste tyres are melted and converted into pyrolysis products. U.S. Pat. No. 3,890,141 discloses a method to treat scrap tyres to produce a fluid material which, in turn, is burned to produce heat energy. The ash in the flue gases is collected by high efficiency air cleaning devices for recovery, and the ash is further processed to recover zinc and titanium therein. U.S. Pat. No. 3,823,223 discloses a method to produce char from the destructive distillation of scrap synthetic rubber for using in rubber enforcement.

U.S. Pat. No. 3,582,279 discloses a method and apparatus for oxidative distillation of vulcanized rubber by partial combustion of waste rubber, using air throughout the still or retort. U.S. Pat. No. 4,983,278 discloses a two-stage treatment apparatus mainly for the treatment of oil shale and tar sand in which the feed undergoes distillation in the first stage and then pyrolysis in the second stage. U.S. Patent Application Publication No. 2004/204620 discloses a large volume pyrolysis reactor with two reacting chambers of similar size for pyrolyzing tyres in a higher energy efficiency.

European Patent Publication No. EP 1,207,190A2 discloses a reactor in which combustion and pyrolysis take place in a same pyrolysis unit, in which the heat produced from the combustion can be used directly to provide energy for the pyrolysis in the same pyrolysis unit.

US Patent Application Publication No. 2002/0159931 discloses a batch pyrolysis facility in which char formed in the pyrolysis reactor is treated in subsequent treatment vessels in which a lower temperature is used to remove the VOCs remains in the residues of the pyrolysis reactor. International Patent Application Publication No. WO02/31082 discloses an apparatus for vacuum pyrolysis of rubber and/or other hydrocarbon material. The apparatus includes tandem batch feed hoopers operated sequentially under vacuum to continuously feed the pyrolysis reactor, and tendem batch collection bins operated in sequence under vacuum to collect the reaction product from the reactor.

Summarizing the existing art, there is no pyrolysis apparatus with pyrolysis chambers of different sizes to cater for the decreasing size of pyrolyzing materials. Neither does any prior art apparatus cater for the possibility of treating waste tyres and the like under different conditions, including high temperature pyrolysis, low temperature pyrolysis and partial combustion. Such conventional apparatus and methods are thus less than satisfactory in terms of flexibility in operation, efficient use of energy, or production cost.

It is thus an objective of the present invention to provide a pyrolysis apparatus and method in which the aforesaid shortcomings are mitigated, or at least to provide a useful alternative to the trade and public.

SUMMARY OF THE INVENTION

According to a first aspect of the present invention, there is provided an apparatus for pyrolysis of carbonizable plastic and rubber materials, including at least a first reaction chamber and a second reaction chamber, wherein said first reaction chamber is adapted to receive said materials for pyrolysis, and wherein said second reaction chamber is adapted to receive treated materials from said first reaction chamber for subsequent pyrolysis, characterized in including means adapted to direct gaseous pyrolysis products in said second reaction chamber to at least two different destinations.

According to a second aspect of the present invention, there is provided a method for pyrolysis of carbonizable plastic and rubber materials, including steps of (a) feeding said materials to a first reaction chamber; (b) carrying out pyrolysis of said material in said first reaction chamber; (c) conveying the treated material from said first reaction chamber to a second reaction chamber; (d) carrying out pyrolysis of said material in said second reaction chamber; characterized in including a step (e) of directing gaseous pyrolysis products in said second reaction chamber to at least two different destinations.

BRIEF DESCRIPTION OF THE DRAWINGS

A preferred embodiment of the present invention will now be described, by way of an example only, in conjunction with the accompanying drawings wherein like reference numerals designate like parts throughout, in which.

DETAILED DESCRIPTION OF THE PREFERRED EMBODIMENT

It should be noted that a main object of the present invention is to provide an apparatus and method which are flexible in tackling the problem of pyrolyzing different sources of hydrocarbon wastes to different target product specifications in different target energy efficiency by using a pyrolysis reactor with a plurality of independently operable reaction chambers.

Figure 1:
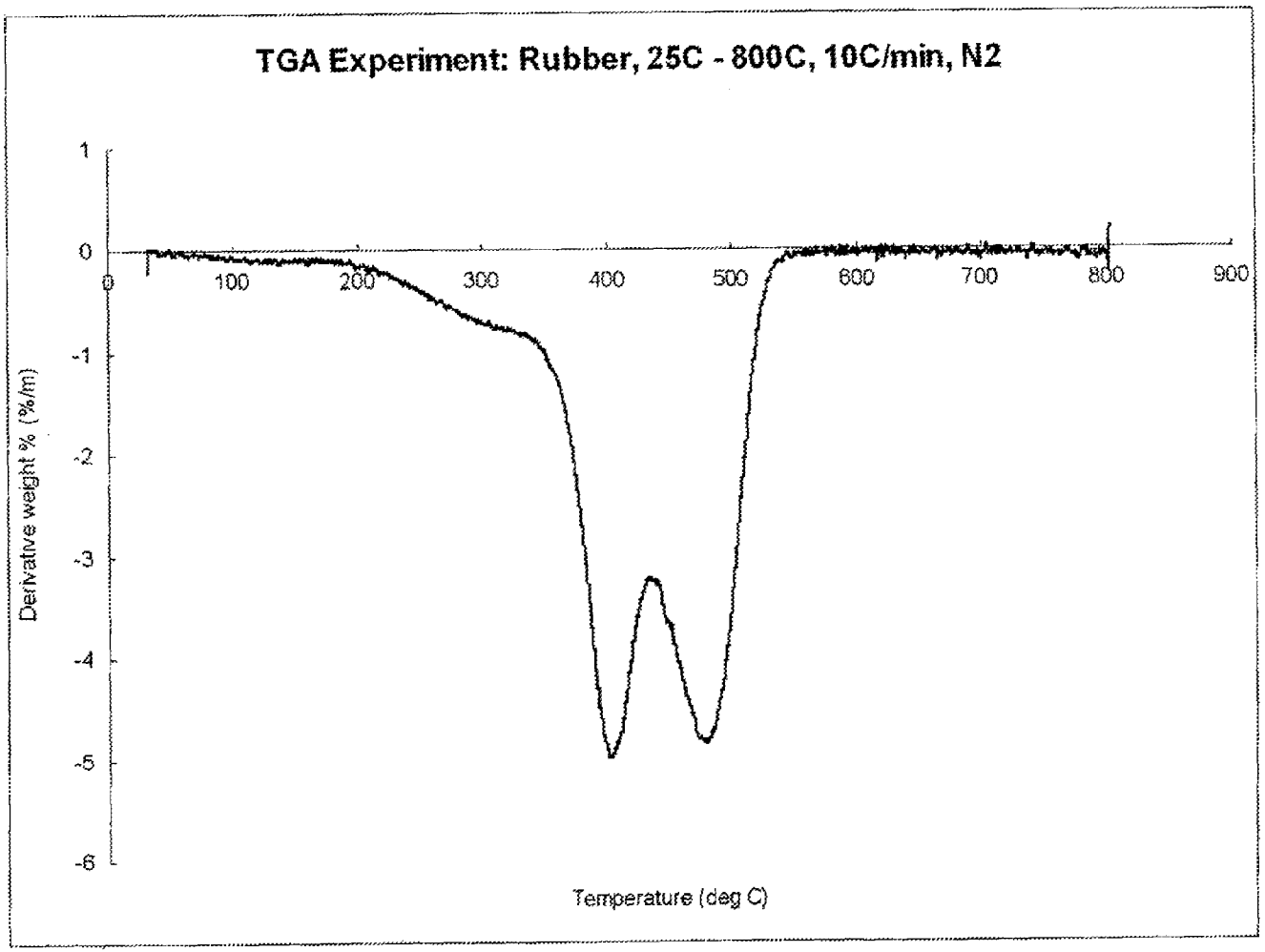
FIG. 1 shows the percentage loss of mass of pyrolysing waste tyres with respect to the pyrolysis temperature.

FIG. 1 shows the result of a thermogravimetric analysis (TGA) experiment on percentage loss of mass of waste tyres undergoing pyrolysis. It can be seen that natural rubber of the waste tyres pyrolyzes and/or cyclized at around 350° C., cyclized constituents, polybutadiene rubber (PBR) and styrene butadiene (SBR) of waste tyres pyrolyzes/cyclized at around 450° C., and nearly all the organic volatiles gasify at a temperature below 600° C. The carbon black and steel wires in the waste tyres will not undergo pyrolysis and will remain as solid residue after the pyrolysis process. By considering the pyrolysis temperatures of the main constituents of waste tyres, a novel multi-stage pyrolysis reactor is provided for pyrolyzing the waste tyres to convert same into valuable end products, including combustible gases, liquid hydrocarbons and solid carbonaceous residues. It should also be noted that after 400° C., the mass of waste tyres remaining after pyrolysis is about half of the original feed mass, and this invention takes into account the specific pyrolysis temperatures and mass change during the pyrolysis process.

Figure 2:
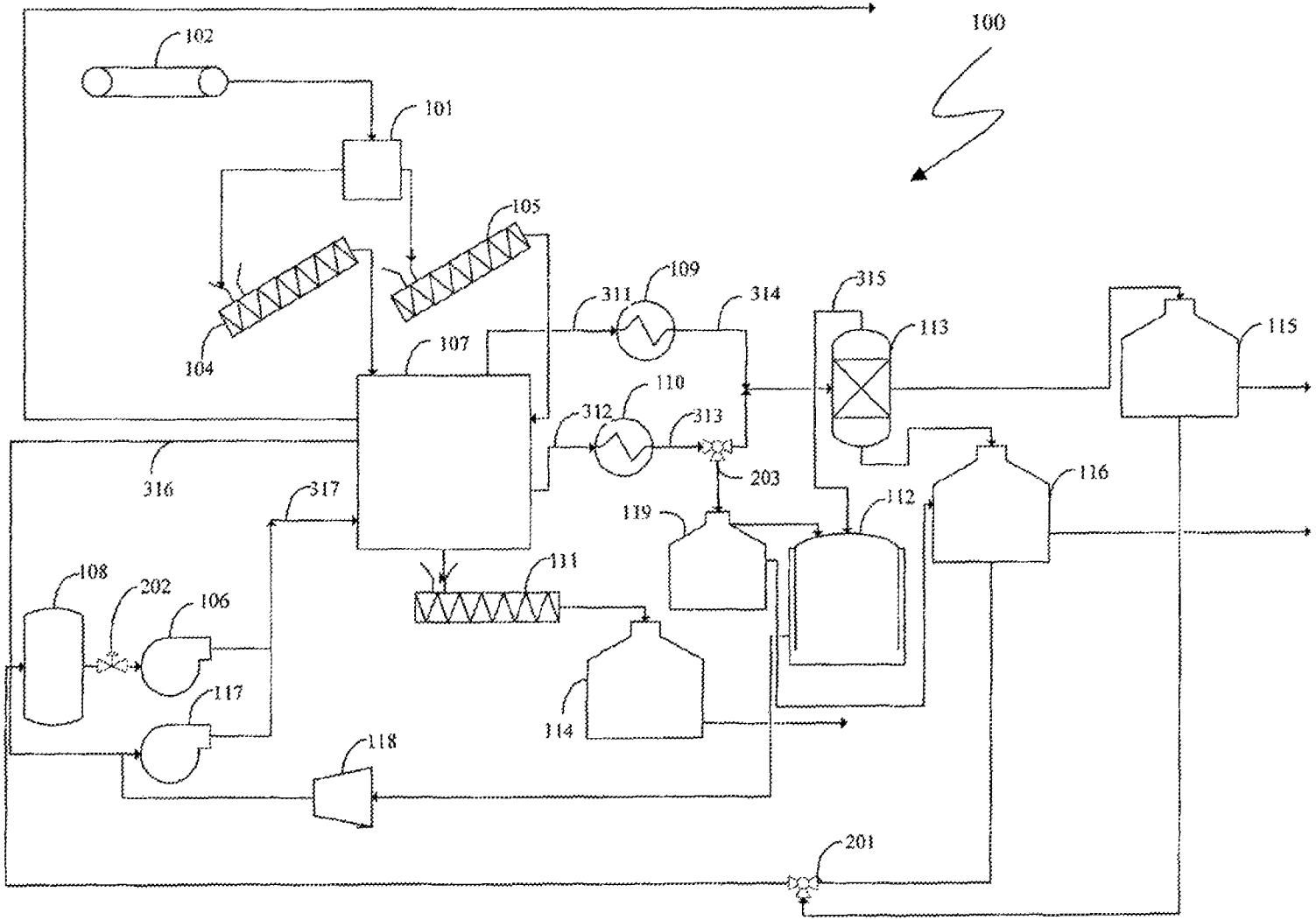
FIG. 2 is a schematic diagram of a plant and the process flow diagram of a method incorporated with a pyrolysis reactor according to a preferred embodiment of the present invention.

As shown in FIG. 2, a pyrolysis reactor (107) according to the present invention can be incorporated into a larger system and plant, generally designated as (100), for converting shredded waste tyres into pyrolysis oil and other useful by-products, including carbon black as well as fuel gas.

In particular, whole tyres are first loaded to an automatic shredder (101) of the plant (100) by the use of a belt conveyor (102). The solid shredded tyres are then transferred into screw conveyors (104, 105) at atmospheric pressure. The number of screw conveyors (104, 105) may be varied according to the target pyrolysis rate. The screw conveyors (104, 105) are tilted upward and the rate of inputting shredded tyres into the screw conveyers (104, 105) is set such that the shredded tyres fill up the void spaces of the screw conveyors (104, 105) so as to prevent air from leaking into a two-stage reactor (107), as excess air can lead to combustion which decreases the quantity of tyres undergoing pyrolysis inside the reactor (107). The shredded tyres are then fed to the two-stage reactor (107). As the feed is fed at atmospheric pressure, so the reactor (107) also operates at atmospheric pressure.

The reactor (107) is heated up by hot air produced from burners (106, 117). One of the burners (106) is a liquid fuel burner, and the burner (117) is a gas burner. Based on the theory that combustion temperature is always above 1000K, the control logic is set by choosing the flue gas flow rate as the control variable and the oil consumption rate as the manipulate variable. The oil consumption rate is controlled by operating a control valve (202). Thus, if the combustion of the pyrolysis gases is capable of producing the required hot air volumetric flow, no oil needs be consumed.

Solid residues from the reactor (107) are collected by a hopper collecting to a screw conveyor (111) and transferred to a storage tank (114) for further treatment. For pyrolysis of tyres, the solid residue contains steel wires and carbon black with small amount of sulfur. For pyrolysis of rubber or plastic, the residues are mainly carbon black.

The pyrolysis gases can exit the two-stage pyrolysis reactor (107) either via streams (311, 312), to be cooled down to room temperature, i.e. around 298K, using two condensers (109), or via a stream (316) which is connected to the gas burner (117) for the purpose of combusting the pyrolysis gases.

Condensate from a later stage (313) is transported to a two-way valve (203) through which the condensate is transported to different destinations according to the user preference. One possible destination is an oil-gas separating tank (119) through which non-condensable vapors generated from the condensate are directed to a gas storage tank (112) and the remaining condensate in the oil-gas separating tank (119) is transported to a diesel storage tank (116).

Another possible option is to mix the condensate from the later stage (313) with another stream (314) of condensate. The mixed condensate is then transported to a fractional distillation column (113), in which non-condensable gases, light fraction of the condensate and heavy fraction of condensate are separated into different streams. The non-condensation gases stream (315) is connected to a gas storage tank (112), the light fraction is collected in a petrol storage tank (115), and the heavy fraction of the condensate is stored in a separate diesel storage tank (116).

The gases stored in the gas storage tank (112) are transported to the gas burner (117) by a compressor (118). The constituents in any stream collected to the gas burner (106, 107) will be burnt for supplying heat to the reactor (107). Some of the pyrolysis oil collected in the oil storage tanks (115, 116) is transported to an oil supply tank (108) to act as fuel for the liquid fuel burner (106). The kind of oil transported to the oil supply tank (108) can be set according to user preferences by using a valve (201). As mentioned earlier, the liquid fuel burner (106) need not operate as long as the non-condensable pyrolysis gases produced throughout the pyrolysis process can sustain the flue gas temperature of 1000K and the required flue gas volumetric flow rate.

Figure 3:
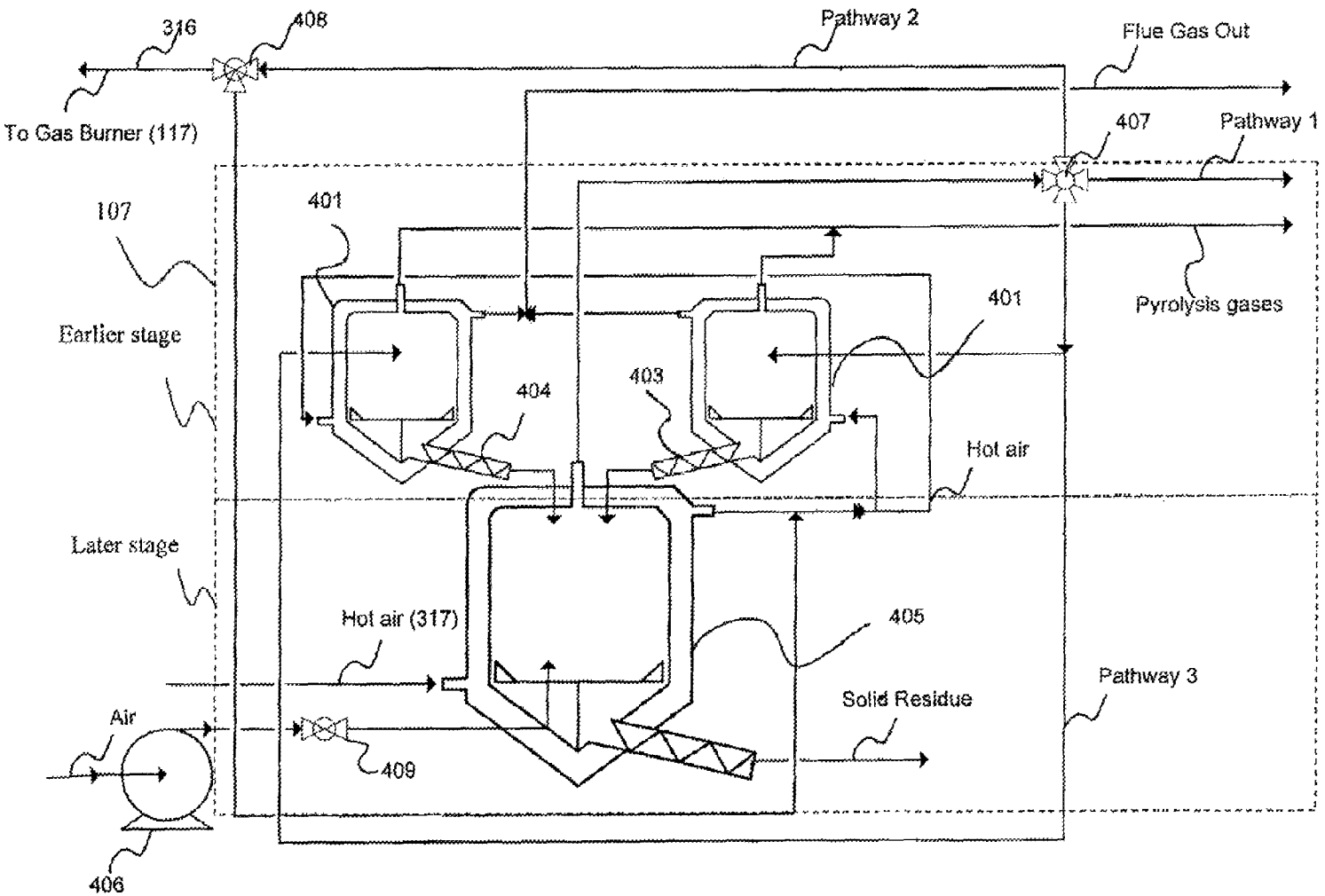
FIG. 3 is a schematic diagram of the structure and arrangement of the pyrolysis reactor of the plant shown in FIG. 2.

Referring to FIG. 3, a pyrolysis reactor (107) according to a preferred embodiment of the present invention comprises a number of reaction chambers (401, 405), each including a mechanical stirrer for stirring the content in the respective reaction chambers (401, 405). Smaller reaction chambers (401) constitute an earlier stage of the reactor (107) and a larger reaction chamber (405) constitutes a later stage. The actual size of each chamber is carefully designed so as to fit the actual sizes of the pyrolysing masses.

It can be seen that the reaction chambers (401) are arranged in parallel with one another, and the reaction chambers (401) are all arranged in series with the reaction chamber (405), such that treated materials from the reaction chambers (401) can be conveyed via screw conveyers (403, 405) to the reaction chamber (405).

With such an arrangement, scaling of the reactor (107) is relatively easy. Adding new reaction chambers (401) in the earlier stage can be a simple solution for scaling up the amount of feed; stopping operation of one or more of the reaction chambers (401) in the earlier stage can be a simple solution for scaling down the pyrolysis. If the pyrolysis volume is required to be increased or decreased significantly, increasing or reducing the number of stages of reaction chambers can solve the problem correspondingly. One of the main advantages of this invention is that the number of chambers and stages can be freely added to or removed from the reactor (107) to tackle different pyrolysis feed volume. It should thus be appreciated that the specific arrangement of the number of the reaction chambers (401) and stages of the reactor (107) as shown and discussed here is for illustration purposes only.

With this arrangement, the heat transfer area to heating volume ratio is larger as compared with conventional designs. The results are better heat transfer and higher energy efficiency. It should be noted that the volume of the chambers (401, 405) is relatively small, and so it is easier to operate mechanical stirrers inside the chambers (401, 405), whereas convention designs make the operation of mechanical stirrer more difficult, as very large power is required to move the stirrer when the pyrolysis volume goes up to 5 tons. Another problem of convention apparatus tackled here is that the present invention makes continuous process possible with the mechanical stirrer operating. Stirring of pyrolysis feed in conventional designs will mix the fed tyres and the solid residue, so that most conventional vertical cylindrical pyrolysis apparatus are designed for batch process, while most apparatus can be used for continuous process if and only if there is no stirrer inside. In the present apparatus, the problem is solved as the feed is fed to the earlier stage, i.e. the reaction chambers (401), in which about 50% of pyrolyzable parts are pryrolyzed, the remaining pyrolyzable parts are then completely pyrolyzed in the later stage, i.e. the reaction chamber (405). Thus, although there is mixing of the feed and the pyrolyzed residue, the solid output from the reactor (107) contains no or very little feed, depending on the operations.

The smaller reacting chambers (401) are connected in parallel in the earlier stage, in which a low temperature pyrolysis takes place at around 200° C.-400° C. The gaseous products of that stage are cooled to room temperature later to yield pyrolysis oil, whereas the non-condensable gases may eventually be directed to the gas burner (117) for combustion to supply energy for the reactor (107). The solid pyrolysis products and the liquid pyrolysis products from the earlier stage are transferred to the later stage through screw conveyors (403, 404). The screw conveyors (403, 404) break down the residues from the earlier stage by mechanical shear and impaction, so as to enhance heat transfer in the later stage, due to larger surface area to volume ratio of the pyrolysing mass.

The later stage comprises a reacting chamber (405) with a size chosen, having taken into account the decreased masses and a relatively higher pyrolysis temperature of around 400° C.-800° C., compared to the pyrolysis chambers (401) of the earlier stage. It should be noted that this chamber (405) operates independently from the chambers (401) and can serve for other purposes different from the pyrolysis process. The gaseous pyrolysis products in that later stage can go into three different pathways, each to a different destination, by adjusting a three-way valve (407). The three different pathways are condensation to yield pyrolysis oil (Pathway 1), combustion to provide energy for the pyrolysis in the reactor (107) (Pathway 2), and pyrolyzing in the earlier stage reacting chambers (401) to yield lighter hydrocarbon chain (Pathway 3).

The three different ways can be adjusted or selected to fit specific process requirement. The residue of the later stage chamber (405) egresses from a screw conveyor. During pyrolysis of waste tyres, the products generated by the reactor (107) are pyrolysis oil, carbon black and steel wire. There are two choices for Pathway 2, the first choice being that only the pyrolysis gases are transported to the gas burner (117) for combustion, and the second choice is to combust the gases, liquid and solid residues inside the later stage chamber (405) directly. In the case of direct combustion inside the chamber (405), a ball valve (409) is manipulated and blower (406) is opened for supplying air for combustion. Only limited oxygen is provided for the combustion inside the later stage chamber (405) so as to ensure no combustion takes place in the earlier stage chambers (401). The hot air produced by the combustion inside the later stage chamber (405) will be transported in the flue gas pathway of the earlier stage by manipulating a ball valve (408), i.e., bypassing the gas burner (117). The screw conveyor of the later stage chamber will operate periodically to egress the incombustible residue in the case of direct combustion inside the chamber (405).

The whole reactor (107) is sealed by liners to prevent any air leaking into the reacting chambers (401, 405). The reactor (107) is perimetrically enclosed by an insulated housing, and heating zones interpose between the housing and the liners for heating the materials inside the liners.

It should be noted that the pyrolysis temperatures are different for each of the stages. As mentioned in many literatures, different pyrolysis temperature yields different kinds of products. Typically, a lower pyrolysis temperature yields hydrocarbons with lower sulfur contents, vice versa. Thus, separate treatments for the pyrolysis oil from different pyrolysis temperatures implies an easier treatment scheme afterwards.

The hot air produced by the gas burner (117) and the liquid fuel burners (106) enters the later stage of the reactor (107) before going into the earlier stage of the reactor (107), resulting in a higher pyrolysis temperature in the chamber (405) and a lower pyrolysis temperature in chambers (401) of the earlier stage. This arrangement can better utilize the heat energy of the hot air.

Figure 4:
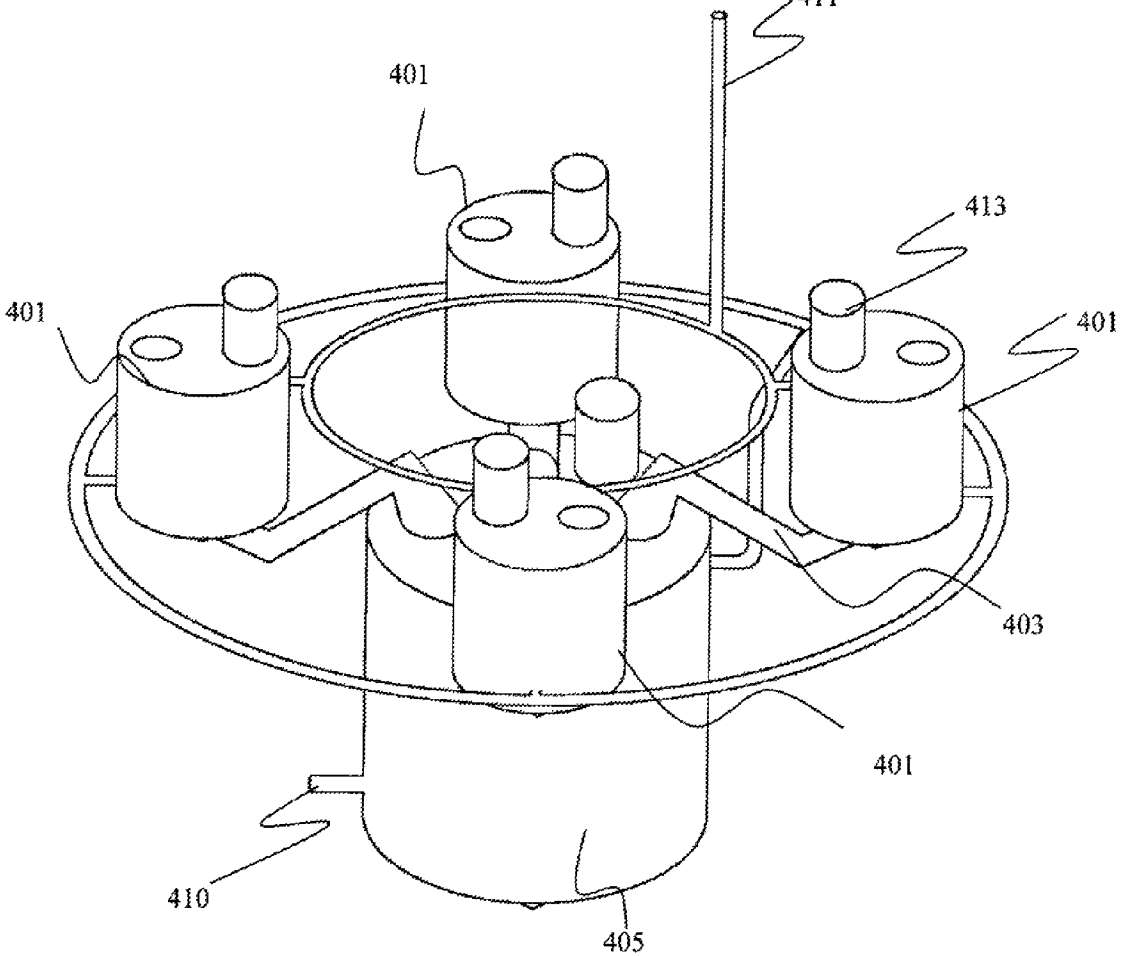
FIG. 4 is a perspective view of the pyrolysis reactor shown in FIG. 3.

FIG. 4 shows the overall layout of the two-stage pyrolysis reactor (107). The smaller reaction chambers (401) are positioned higher than the larger chamber (405). The size of the chambers (401, 405) should take into account the decrease of mass of the pyrolysing materials. The inter-stage connection(s) are achieved by screw conveyors so as to ensure no oxygen can leak into the system. Hot air enters the reactor (107) via an entrance (410) of the later stage reaction chamber (405) and exits the reactor (107) via outlets (413) of the earlier stage reaction chambers (401). Each of the chambers (401, 405) has two outlets: one opened on the top for the egress of gaseous products from the chambers (401, 405), and one opened at the bottom of the reaction chambers (401, 405) for the egress of solid products of the reaction chambers (401, 405). Each of the earlier stage chambers (401) has one inlet for the ingress of the fragmented tyres and the like as the feed to the reactor (107) and one inlet for the possible injection of later stage gaseous pyrolysis product. The later stage reaction chamber (405) includes a number of inlets, the number of which being equal to the number of earlier stage reaction chambers (401), as the outlets of the earlier stage reaction chambers (401) are connected to the inlet of the later stage chamber (405).

Operation of the reactor (107) and method discussed above are further illustrated in the following working examples.

Example I

Case 1

Using the plant (100) shown in FIG. 2, shredded tyres of a maximum dimension of about 50 mm×50 mm×50 mm with the composition of Table 1 below were fed at a rate of about 500 kg/hr to each of two identical earlier stage reaction chambers (401) of the reactor (107), Each earlier stage reaction chamber (401) is a cylinder with an inner diameter of 1.5 meters and a height of 1.8 meters.

TABLE 1

Composition of the Tyres Shreds

| | | Wt. % |
|---|---|---|
| Organics | C | 47.3 |
| | H | 6.7 |
| | O | 1.2 |
| | N | 0.3 |
| | S | 0.7 |

TABLE 1-continued

| Composition of the Tyres Shreds | | |
|---|---|---|
| | | Wt. % |
| Inorganic | Carbon Black | 32.4 |
| | Steel | 11.4 |
| Total | | 100.0 |

The screw conveyors (403, 404) were started to transport the residue at the lower part of the earlier stage reaction chambers (401) to the later stage reaction chamber (405), which is of an inner diameter of 2.4 meters and a height of 2.4 meters.

The hot air from the gas burner (117) and the liquid fuel burners (106) first entered the later stage reaction chamber (405) of the reactor (107) at a temperature of 1043K and exited the chamber (405) at a reduced temperature of 873K. The flue gas then entered the earlier stage reaction chambers (401) at a further reduced temperature of 868K and finally exited the pyrolysis reactor (107) at a still further reduced temperature of 614K.

The pyrolysis gases from different stages were condensed in different containers, i.e., taking Pathway 1 shown in FIG. 3. Samples were taken from each of the condensate (314, 313) after the system processed for two hours. The properties of the condensates, i.e., pyrolysis oils, are as follows:

TABLE 2

| Properties of Condensate, i.e., Pyrolysis Oil, from the Earlier Stage (from 314) and the Later Stage (313) | | | |
|---|---|---|---|
| | | Stream 314 Wt. % | Stream 313 Wt. % |
| Elemental Composition | Carbon (C) | 85.1 | 86.5 |
| | Hydrogen (H) | 11.2 | 10.0 |
| | Oxygen (O) | 3.1 | 2.6 |
| | Nitrogen (N) | 0.3 | 0.3 |
| | Sulfur (S) | 0.3 | 0.6 |
| Chemical Composition | Total Aromatics | 51.2 | 78.8 |
| Physical Properties | Specific Gravity (SG) | 0.86 | 0.91 |
| | Gross Calorific Value (GCV) | 43.5 MJ/kg | 42.7 MJ/kg |
| | 50% Recovery by ASTM D86 Method | 478 K | 597 K |
| | Viscosity | 1.2 cSt | 1.9 cSt |

"Specific gravity" is a dimensionless ratio of the densities of a material with reference to water. Mathematically, specific gravity is expressed as:

$$G = \frac{\rho_{object}}{\rho_{water}}$$

where "G" is the specific gravity,

"$\rho_{object}$" is the density of the material, and

"$\rho_{water}$" is the density of water, which is approximately 1000 kg/m$^3$.

The "calorific value" of a substance is the amount of heat released during the combusion of a specified amount of it. This value is measured in units of energy per unit of the substance, usually mass. As to "gross calorific value" (also called "gross energy" or "higher heating value"), such is determined by bringing all the products of combustion back to the original pre-combustion temperature, and in particular condensing any vapour (e.g. water vapour) produced.

"ASTM D86 method" is a method (as set down by ASTM International) for testing the temperature required to evaporate a specific amount of tested petroleum products.

The mixing of all the pyrolysis oils obtained in the above process yields pyrolysis oil with the properties shown in Table 3 below.

TABLE 3

| Properties of Mixed Oils | | |
|---|---|---|
| | | Wt. % |
| Elemental Composition | C | 85.6 |
| | H | 10.8 |
| | O | 3.2 |
| | N | 0.3 |
| | S | 0.5 |
| Chemical Composition | Total Aromatics | 61.7 |
| Physical Properties | S.G. | 0.88 |
| | GCV | 42.9 MJ/kg |
| | 50% Recovery by ASTM D86 Method | 546 K |
| | Viscosity | 1.6 cSt |

Case 2

The valve (407) was manipulated to turn to Pathway 2, through which the pyrolysis gases from the later stage were transported to the gas burner (117). The pyrolysis gases from the later stage entered the gas burner (117) at a temperature of 465K and was completely combusted by the gas burners (117). The oil supply tank (108) was monitored for the comparison of the oil consumption at the steady states of the system between using different pathways. The results are shown in Table 5 below.

Case 3

The valve (407) was again manipulated, so that the pyrolysis gas of the later stage of the pyrolysis reactor followed Pathway 3. The temperature of the later stage pyrolysis gases entering the earlier stage reaction chambers (401) is 477K. The temperature of the flue gas exiting the outlet was measured and was found to be the same as the pervious two cases, namely, case 1 and case 2. The pyrolysis gases were condensed, the properties of that oil was analyzed. The analysis results were tabulated in Table 4.

TABLE 4

| Properties of the Condensate, i.e., Pyrolysis Oil from the Later Stage | | |
|---|---|---|
| | | Wt. % |
| Elemental Composition | C | 85.5 |
| | H | 10.7 |
| | O | 3 |
| | N | 0.3 |
| | S | 0.5 |
| Chemical Composition | Total Aromatics | 55.7 |
| Physical Properties | S.G. | 0.88 |
| | GCV | 43.0 MJ/kg |
| | 50% Recovery by ASTM D86 Method | 514 K |
| | Viscosity | 1.4 cSt |

It can be seen that the properties shown in Table 4 are different from the oil properties shown in Table 3. This shows that there had been further pyrolysis of the pyrolysis gases from the later stage.

The consumption of oil by the oil burner and the total product recoveries for each of the systems using different pathways are tabulated as bellows:

TABLE 5

Oil Consumption of Liquid Fuel Burner and Recovery of Product Using Different Pathways

| Pathway | Burner Oil Consumption (kg/min) | Product Recovery (Wt. %) Oil | Solid | Gas |
|---|---|---|---|---|
| 1 | 0.6 | 41.2 | 45.7 | 13.1 |
| 2 | 0.1 | 30.9 | 45.6 | — |
| 3 | 0.6 | 38.7 | 46.3 | 15.0 |

Note that the sum of all the weight percentages of products in Pathway 2 is not equal to 100%, as all pyrolysis gases formed in later stage of this pathway were burned directly.

The solid residues from later stage of different schemes were analyzed. Steel wires were separated by a magnetic separator. The remaining residue was analyzed by an element analyzer. It was found that the elemental compositions of different schemes are very similar. The averaged values of the solid residues of the three different schemes are listed as below:

TABLE 6

Solid Residue from the Apparatus

| | Wt. % |
|---|---|
| Steel | 26 |
| C | 72.2 |
| H | 1.1 |
| N | 0 |
| S | 0.7 |
| O | 0 |
| Total | 100 |

Example II

Using the plant (100) shown in FIG. 2, a mixture of plastic and rubber having the mixing ratio and elemental composition shown in Table 7 below was loaded into the plant (100), and thus the reactor (107), which is the same as the one used in Example I, except that there are four identical earlier stage reaction chambers (401), which are identical to those used in example I, discussed above.

TABLE 7

Mixing Ratio of the Feed and its Elemental Composition

| | Wt. % |
|---|---|
| PE | 30 |
| PP | 20 |
| PS | 35 |
| Nature Rubber | 15 |
| C | 41 |
| H | 59 |
| O | 0 |
| N | 0 |
| S | 0 |

Pathway 1 was chosen in this example. In Trial 1, the aforesaid mixture was fed to two of the earlier stage reacting chambers (401) at a rate of 500 kg/hr. In Trial 2, the above mixture was fed to the four earlier stage reaction chambers (401) at a rate of 250 kg/hr. Keeping all other operation variables constant, the flue gas temperatures of the two different trials were summarized in Table 8 and the properties of the pyrolysis oil products were compared and summarized in Table 9.

TABLE 8

Flue Gas Temperatures of the Trials

| | Temperature (K) Trial 1 | Trial 2 |
|---|---|---|
| Enter the 2nd stage | 1043 | 1043 |
| Exit the 2nd stage | 873 | 881 |
| Enter the 1st stage | 868 | 875 |
| Exit the 1st stage | 614 | 581 |

TABLE 9

Properties of the Pyrolysis Oil of Trial 1 and Trial 2

| | | Trial 1 | Trial 2 |
|---|---|---|---|
| Elemental Composition | C | 39.9 | 40.0 |
| | H | 60.1 | 60.0 |
| | O | 0.0 | 0.0 |
| | N | 0.0 | 0.0 |
| | S | 0.0 | 0.0 |
| Chemical Composition | Total Aromatics | 19.0 | 18.7 |
| Physical Properties | S.G. | 0.82 | 0.82 |
| | GCV | 43.2 MJ/kg | 44.1 MJ/kg |
| | 50% Recovery by ASTM D86 Method | 432 K | 426 K |
| | Viscosity | 1.9 cSt | 2.1 cSt |

It should be understood that the above only illustrates an example whereby the present invention may be carried out, and that various modifications and/or alterations may be made thereto without departing from the spirit of the invention.

For example, an apparatus and a method according to the present invention may be used for treating wastes containing mercury and waste tyres, in which case the pyrolysis temperature are provided as follows:

natural rubber, at 623K; and cyclized organic materials, polybutadiene rubber (PBR) and styrene butadiene (SBR) of waste tyres, at 723K; and all other organic matters, at 873K.

Although mercury is not pyrolyzable, it will evaporate (or gasify) at 633K.

In this case, a three-stage reactor may be provided, including:

a stage one pyrolysis chamber for pyrolyzing natural rubber at a temperature of 623K;

a stage two chamber for heating and evaporating mercury at 673K; and a stage three pyrolysis chamber for pyrolyzing cyclized organic materials, polybutadiene rubber (PBR) and styrene butadiene (SBR) of waste tyres and all other organic matters at 873K.

By way of such an arrangement, oil from the stage three pyrolysis chamber can be free of mercury and organo-metallic complex, which are highly toxic.

Thus, the present invention envisages that one or more chamber for treating non-pyrolyzable materials is provided (a) upstream of the earlier stage reaction chamber (401), (b) between the earlier stage reaction chamber (401) and the later stage reaction chamber (405), and/or (c) downstream of later stage reaction chamber (405), as may be necessary.

It should also be understood that the amount (in terms of both mass and volume) of pyrolyzable, gasifiable or vaporizable (PGV) materials decrease during the course of treatment by the present system. Take the pyrolysis of waste tyres as an example, after having gone through the one of the earlier stage reaction chambers (401) which heats the material up to 350° C. to 400° C., the mass and volume of the waste tyre material would significantly reduce, usually by up to 50%. Thus, if the volume of the later stage reaction chamber (405) is equal to that of the earlier stage chamber (401), the later stage reaction chamber (405) can process residues from two earlier stage chambers (401).

In addition, although the embodiment discussed above shows that the reactor (107) includes a plurality of earlier stage reaction chambers (401) and one later stage reaction chamber, it is envisaged that the reactor (107) may comprise more than two stages, and that each stage may comprise a plurality of reaction chambers, in which each reaction chamber is independently operable.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

What is claimed is:

1. An apparatus for continuous pyrolysis of carbonizable plastic and rubber materials, the apparatus comprising:

at least two earlier-stage reaction chambers and a later-stage reaction chamber, said earlier-stage reaction chambers being adapted to receive said carbonizable plastic and rubber materials at near atmospheric pressure for undergoing a first pyrolysis thereof, said later-stage reaction chamber being adapted to receive said materials after treatment within said earlier-stage reaction chambers for a subsequent pyrolysis thereof, said apparatus having means for directing gaseous pyrolysis products generated in said later-stage reaction chamber to at least two different destinations, and having means adapted to direct gaseous pyrolysis products from said earlier-stage reaction chambers to a first destination and gaseous pyrolysis products from said later-stage reaction chamber to two different destinations, wherein the means for directing gaseous pyrolysis products generated in said later-stage reaction chamber is a three-outlet valve adapted to selectively direct said gaseous pyrolysis products generated in said later-stage reaction chamber to one of three different destinations, and, wherein said three-outlet valve is used to selectively direct said gaseous pyrolysis products generated in said later-stage reaction chamber to one of:

a burner for providing heat to at least one of said reaction chambers;

at least one of said earlier-stage reaction chambers without condensing said gaseous pyrolysis products; and, a means for condensing said gaseous pyrolysis products to form a pyrolysis oil.

2. The apparatus according to claim 1 wherein the means for directing gaseous pyrolysis products generated in said later-stage reaction chamber directs at least part of the gaseous pyrolysis products to the burner for providing heat to at least one of said earlier or later stage reaction chambers.

3. The apparatus according to claim 1 wherein the means for directing gaseous pyrolysis products generated in said later-stage reaction chamber directs at least part of the gaseous pyrolysis products to the at least one of said earlier-stage reaction chambers without condensing said gaseous pyrolysis products.

4. The apparatus according to claim 1 wherein the means for directing gaseous pyrolysis products generated in said later-stage reaction chamber directs at least part of the gaseous pyrolysis products to the means for condensing said products to form a pyrolysis oil.

5. A method for continuous pyrolysis of carbonizable plastic and rubber materials comprising the steps of:

(a) feeding said carbonizable plastic and rubber materials to at least two earlier-stage reaction chambers;

(b) carrying out a pyrolysis of said carbonizable plastic and rubber material at near atmospheric pressure in said earlier-stage reaction chambers, forming a treated material;

(c) conveying the treated material from said earlier-stage reaction chambers to a later-stage reaction chamber;

(d) carrying out pyrolysis of said treated material in said later-stage reaction chamber; and, (e) directing gaseous pyrolysis products generated in said later-stage reaction chamber to at least two different destinations;

(f) directing gaseous pyrolysis products from said earlier-stage reaction chambers to a first destination and gaseous pyrolysis products from said later-stage reaction chamber to two different destinations, (g) directing the gaseous pyrolysis products generated in said later-stage reaction chamber using a three-outlet valve adapted to selectively direct said gaseous pyrolysis products generated in said later-stage reaction chamber to one of three different destinations, and, (h) using said three-outlet valve to selectively direct said gaseous pyrolysis products generated in said later-stage reaction chamber to one of:

a burner for providing heat to at least one of said reaction chambers;

at least one of said earlier-stage reaction chambers without condensing said gaseous pyrolysis products; and, a means for condensing said gaseous pyrolysis products to form a pyrolysis oil.

6. The method according to claim 5 further comprising directing at least part of the gaseous pyrolysis products generated in said later-stage reaction chamber to the burner for providing heat to at least one of said earlier or later stage reaction chambers.

7. The method according to claim 5 further comprising directing at least part of the gaseous pyrolysis products generated in said later-stage reaction chamber to the at least one of said earlier-stage reaction chambers without condensing said gaseous pyrolysis products.

8. The method according to claim 5 further comprising directing at least part of the gaseous pyrolysis products generated in said later-stage reaction chamber to the means for condensing said products to form a pyrolysis oil.

* * * * *